US009213307B2

(12) United States Patent
Abe et al.

(10) Patent No.: US 9,213,307 B2
(45) Date of Patent: Dec. 15, 2015

(54) DRUM CARTRIDGE WITH MOVABLE CLEANING ROLLER

(71) Applicant: BROTHER KOGYO KABUSHIKI KAISHA, Nagoya-shi, Aichi-ken (JP)

(72) Inventors: Koji Abe, Nagoya (JP); Hideaki Deguchi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/666,061

(22) Filed: Mar. 23, 2015

(65) Prior Publication Data

US 2015/0277348 A1 Oct. 1, 2015

(30) Foreign Application Priority Data

Mar. 31, 2014 (JP) ..... 2014-071829

(51) Int. Cl.
*G03G 21/16* (2006.01)
*G03G 21/18* (2006.01)

(52) U.S. Cl.
CPC ..... *G03G 21/169* (2013.01); *G03G 21/1825* (2013.01)

(58) Field of Classification Search
CPC ..... G03G 21/169; G03G 21/1825; G03G 21/1821
See application file for complete search history.

(56) References Cited

U.S. PATENT DOCUMENTS

| | | | | |
|---|---|---|---|---|
| 5,572,293 | A * | 11/1996 | Kikuchi et al. | 399/357 |
| 2004/0037590 | A1 | 2/2004 | Morioka et al. | |
| 2004/0052557 | A1 | 3/2004 | Fukuta et al. | |
| 2007/0071495 | A1* | 3/2007 | Hashimoto et al. | 399/111 |
| 2009/0297208 | A1* | 12/2009 | Suzuki et al. | 399/109 |
| 2010/0278571 | A1 | 11/2010 | Abe et al. | |
| 2011/0236060 | A1* | 9/2011 | Takagi | 399/113 |
| 2013/0108322 | A1 | 5/2013 | Nishimoto | |

FOREIGN PATENT DOCUMENTS

| | | | |
|---|---|---|---|
| JP | 2003307993 | A | 10/2003 |
| JP | 2004118095 | A | 4/2004 |
| JP | 2008032955 | A | 2/2008 |
| JP | 2010262097 | A | 11/2010 |
| JP | 2011-7826 | A | 1/2011 |
| JP | 2011095711 | A | 5/2011 |
| JP | 2013097151 | A | 5/2013 |

* cited by examiner

*Primary Examiner* — Rodney Bonnette
(74) *Attorney, Agent, or Firm* — Merchant & Gould P.C.

(57) ABSTRACT

A drum cartridge and a method are disclosed. An example drum cartridge includes a photosensitive drum, a first cleaning roller positioned to a side of the photosensitive drum. The drum cartridge includes a lever positioned at an outer surface of the drum cartridge. The outer surface of the drum cartridge is positioned toward the side of the photosensitive drum. The lever is extendable in a second direction different from the first direction, and the lever is pivotable with respect to the outer surface of the drum cartridge about a second axis extending in the first direction. The lever is pivotable between an extended position and a retracted position. The drum cartridge includes an engagement portion movable with pivoting of the lever between an engaged position when the lever is in the extended position and a disengaged position when the lever is in the retracted position.

25 Claims, 12 Drawing Sheets

DRUM CARTRIDGE WITH MOVABLE CLEANING ROLLER

CROSS-REFERENCE TO RELATED APPLICATION

This application claims priority from Japanese Patent Application No. 2014-071829 filed on Mar. 31, 2014, which is incorporated herein by reference in its entirety.

TECHNICAL FIELD

The disclosure relates to a photosensitive member cartridge configured to be accommodated in an electrophotographic image forming apparatus.

BACKGROUND

A known drum cartridge includes a photosensitive drum and is accommodated in an electrophotographic image forming apparatus. In the drum cartridge, a developing agent image is carried on a surface of the photosensitive drum during an image forming operation. The developing agent image is transferred on a recording medium.

A known drum cartridge includes, for example, a cleaning unit configured to clean a surface of the photosensitive drum. In the drum cartridge, the cleaning unit includes a first cleaning roller configured to contact the surface of the photosensitive drum. As an image forming operation is started and the photosensitive drum rotates, the first cleaning roller collects paper powders or fibers on the photosensitive drum.

SUMMARY

In a first example aspect, a drum cartridge includes a photosensitive drum rotatable about an axis extending in a first direction, and a first cleaning roller positioned to a side of the photosensitive drum and including a first shaft extending in the first direction. The drum cartridge further includes a bearing through which the first shaft is inserted and a pressing member configured to press the bearing toward the photosensitive drum. The drum cartridge further includes a lever positioned at an outer surface of the drum cartridge, the outer surface of the drum cartridge positioned toward the side of the photosensitive drum, the lever extendable in a second direction different from the first direction, the lever being pivotable with respect to the outer surface of the drum cartridge about a second axis extending in the first direction, the lever pivotable between an extended position and a retracted position. The drum cartridge further includes an engagement portion movable with pivoting of the lever between an engaged position when the lever is in the extended position and a disengaged position when the lever is in the retracted position. In the engaged position the engagement portion engages the bearing to position the first cleaning roller spaced apart from the photosensitive drum, and in the disengaged position the engagement portion disengages from the bearing and the first cleaning roller contacts the photosensitive drum.

In a further example aspect, a method is includes pivoting a lever from an extended position to a retracted position, the lever extending from an outer surface at a side of a drum cartridge. The drum cartridge further includes a photosensitive drum, and a first cleaning roller positioned toward the side of the drum cartridge relative to the photosensitive drum and including a first shaft extending in the first direction. The drum cartridge includes a bearing through which the first shaft is inserted, and a pressing member configured to press the bearing toward the photosensitive drum. The drum cartridge further includes an engagement portion movable between an engaged position when the lever is in the extended position and a disengaged position when the lever is in the retracted position. In the engaged position, the engagement portion engages the bearing to position the first cleaning roller spaced apart from the photosensitive drum, and pivoting the lever from the extended position to the retracted position disengages the engagement portion from the bearing, allowing the first cleaning roller to contact the photosensitive drum.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

According to an aspect of the disclosure, when a recording medium gets caught between the cleaning member and the photosensitive member in a photosensitive member cartridge, a recording medium may be readily removed.

BRIEF DESCRIPTION OF THE DRAWINGS

Reference now is made to the following description taken in connection with the accompanying drawings.

DETAILED DESCRIPTION

In general, the present disclosure relates to a photosensitive drum cartridge usable in an electrophotographic image forming apparatus. In a known drum cartridge, when a recording medium gets caught between the first cleaning roller and the photosensitive drum, the recording medium may be difficult to be removed. More specifically, as an image forming operation is performed with a recording medium, for example, curved, the recording medium being fed may enter between the first cleaning roller and the photosensitive drum after passing through a transfer position of the photosensitive drum. In such case, the recording medium may be difficult to be removed. However, some embodiments of the disclosure address such issues by providing a drum cartridge in which a surface of the first cleaning roller can be spaced apart from a surface of the photosensitive drum when a lever pivots with respect to an outer surface of the drum cartridge. In the drum cartridge according to some aspects of the disclosure, a surface of the first cleaning roller can be spaced apart from a surface of the photosensitive drum when a lever pivots. For example, a lever pivoting with respect to an outer surface of the drum cartridge accommodates such movement of the first cleaning roller. In example embodiments, the lever can be positioned to interact with a surface of an image forming apparatus, to ensure engagement of the cleaning roller and photosensitive drum when the drum cartridge is installed in an image forming apparatus.

1. General Structure of Printer

Figure 1:
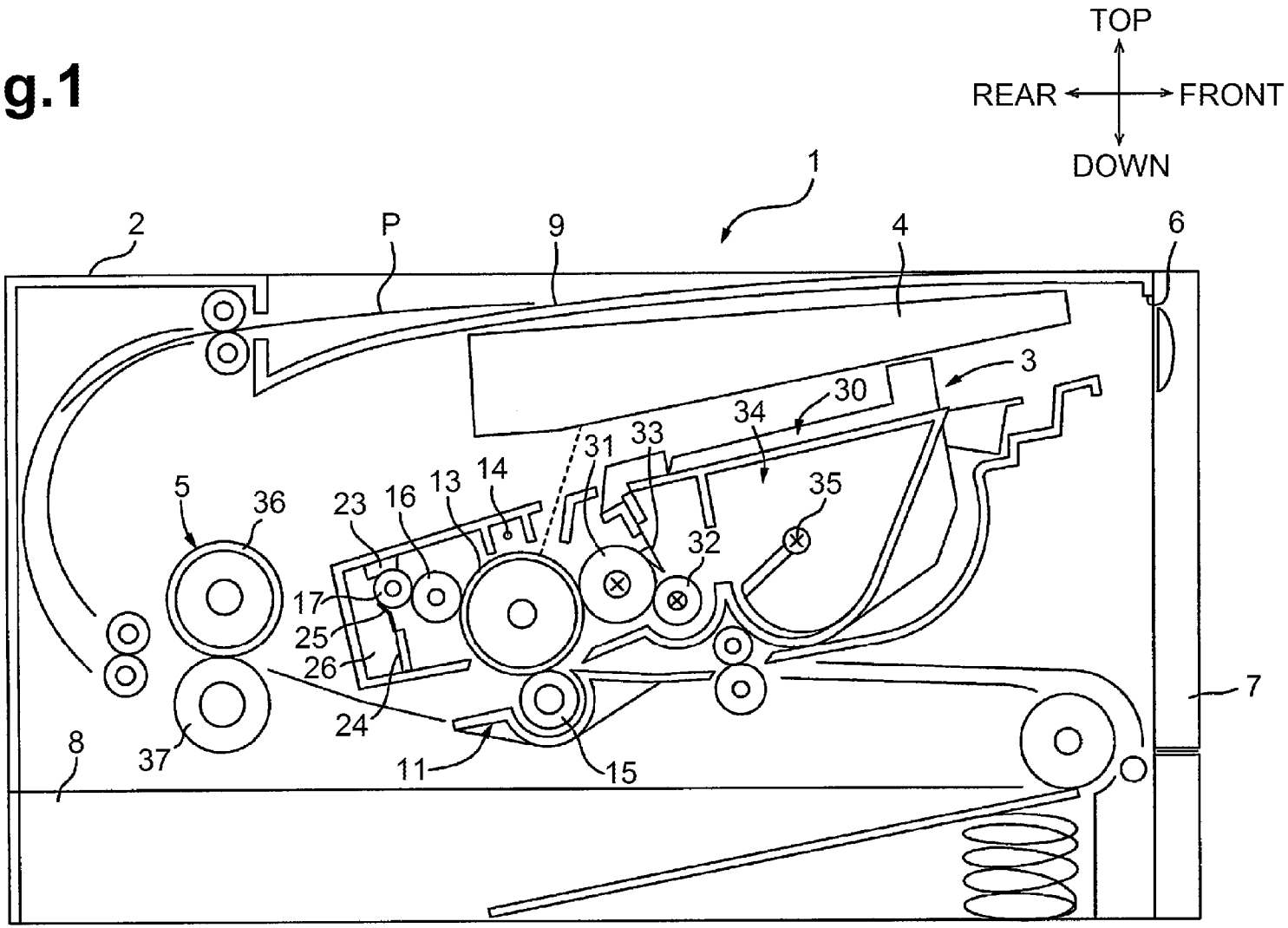
FIG. 1 is a sectional view of a printer in an illustrative embodiment according to one or more aspects of the disclosure.

As depicted in FIG. 1, the printer 1 may be an electrophotographic monochrome printer. The printer 1 includes a main casing 2, a process cartridge 3, a scanner unit 4, and a fixing unit 5. In the description below, the right side of the sheet of FIG. 1 is defined with reference to the front of the printer 1, and the left of the sheet of FIG. 1 is defined with reference to the rear of the printer 1. The upper side of the sheet of FIG. 1 is defined with reference to the top of the printer 1, and the lower side of the sheet of FIG. 1 is defined with reference to the bottom of the printer 1. The left and right sides of the printer 1 are determined when viewed from the front side. More specifically, the front side of the sheet of FIG. 1 is defined with reference to the left side of the printer 1, and the rear side of the sheet of FIG. 1 is defined with reference to the right side of the printer 1.

The main casing 2 has a generally box shape. The main casing 2 includes an opening portion 6, a front cover 7, a sheet supply tray 27, and a sheet discharge tray 9.

The opening portion 6 is positioned at a front end portion of the main casing 2. The opening portion 6 allows an interior and an exterior of the main casing 2 to communicate with each other in the front-rear direction. The opening portion 6 permits the process cartridge 3 to be passed therethrough.

The front cover 7 is positioned at a front end portion of the main casing 2. The front cover 7 has a generally flat plate shape. The front cover 7 extends in the top-bottom direction. The front cover 7 is pivotally supported about a lower end portion thereof by the front wall of the main casing 2. The front cover 7 is configured to open or close the opening portion 6.

The sheet supply tray 8 is positioned at a bottom portion of the main casing 2. The sheet supply tray 8 is configured to accommodate a recording medium, e.g., a sheet P.

The sheet discharge tray 9 is positioned at the upper surface of the upper wall of the main casing 2. The sheet discharge tray 9 is depressed downward from the upper surface of the main casing 2 for receiving the sheets P.

The process cartridge 3 is accommodated in a generally central portion of the main casing 2 in the top-bottom direction. The process cartridge 3 is configured to be attached to or removed from the main casing 2, via the opening portion 6. The process cartridge 3 includes the drum cartridge 11 and a developing cartridge 30.

The drum cartridge 11 includes a photosensitive drum 13, a scorotron charger 14, a transfer roller 15, a first cleaning roller 15, a second cleaning roller 12, a sponge scraper 23, partition wall 24, and a paper dust reservoir 26.

The photosensitive drum 13 has a generally tubular shape extending in the left-right direction. The photosensitive drum 13 is rotatably supported at a rear portion of the drum cartridge 11. Each end portion of the photosensitive drum 13 in the left-right direction is rotatably supported by the drum cartridge 11.

The scorotron charger 14 is positioned above the photosensitive drum 13 with a space between the scorotron charger 14 and a surface of the photosensitive drum 13.

The transfer roller 15 has a generally tubular shape extending in the left-right direction. The transfer roller 15 is rotatably supported by the drum cartridge at a rear portion of the drum cartridge 11. Each end portion of the transfer roller 15 in the left-right direction is rotatably supported by the drum cartridge 10. The transfer roller 15 is disposed below the photosensitive drum 13. An upper end portion of the transfer roller 15 (e.g., a surface of the transfer roller 15) is in contact with a lower end portion of the photosensitive drum 13 (e.g., a surface of the photosensitive drum 13).

The first cleaning roller 16 has a generally tubular shape extending in the left-right direction. The first cleaning roller 16 is rotatably supported by the drum cartridge at a front end portion of the drum cartridge 11. Each end portion of the first cleaning roller 16 in the left-right direction is rotatably supported by the drum cartridge. A lower front portion of the first cleaning roller 16 (e.g., a surface of the first cleaning roller 16) is in contact with an upper rear end portion of the photosensitive drum 13 (e.g., a surface of the photosensitive drum).

The second cleaning roller 17 is rotatably supported by the drum cartridge at a front end portion of the drum cartridge 11. Each end portion of the second cleaning roller 17 in the left-right direction is rotatably supported by the drum cartridge 11. The second cleaning roller 17 is positioned at a rear side of the first cleaning roller 16. A lower front end portion of the second cleaning roller 17 (e.g., a surface of the second cleaning roller 17) contacts an upper rear end portion of the first cleaning roller 16 (e.g., a surface of the first cleaning roller 16).

The sponge scraper 23 is positioned at an upper rear portion of the drum cartridge 11. More specifically, the sponge scraper 23 is positioned at an upper side of the second cleaning roller 17. The sponge scraper 23 is in contact with an upper end portion of the second cleaning roller 17 (e.g., a surface of the second cleaning roller 17).

The partition wall 24 is positioned at a lower rear portion of the drum cartridge 11. More specifically, the partition wall 24 is positioned at a lower portion of the second cleaning roller 17 with a space between the partition wall 24 and a surface of the second cleaning roller 17. The partition wall 24 has a generally flat plate shape. A film 25 is attached to an upper end portion of the partition wall 24. The film 25 extends from an upper end portion of the partition wall 24 upwardly. An upper end of the film 25 is in contact with a lower end portion of the second cleaning roller 17 (e.g., a surface of the second cleaning roller 17).

The paper dust reservoir 26 is positioned at a rear portion of the drum cartridge 11. More specifically, the paper dust reservoir 26 is arranged at a rear side of the second cleaning roller 17, the sponge scraper 23, the partition wall 24, and the film 25 in the drum cartridge 11.

The developing cartridge 30 is configured to be accommodated in the drum cartridge 11 in front of the photosensitive drum 13. The developing cartridge 30 includes a developing roller 31, a supply roller 32, a layer thickness regulation blade 33, and a toner chamber 34.

The developing roller 31 has a generally cylindrical shape extending in the left-right direction. The developing roller 31 is rotatably supported at a rear end portion of the developing cartridge 30. A rear end portion of the developing roller 31 (e.g., a surface of the developing roller 31) is in contact with a front end portion of the photosensitive drum 13 (e.g., a surface of the photosensitive drum 13).

The supply roller 32 has a generally cylindrical shape extending in the left-right direction. The supply roller 32 is rotatably supported at a rear end portion of the developing cartridge 30. The supply roller 32 is positioned at a front lower portion of the developing roller 31. An upper rear end portion of the supply roller 32 (e.g., a surface of the supply roller 32) contacts a lower front end portion the developing roller 31 (e.g., a surface of the developing roller 31).

The layer thickness regulation blade 33 is positioned at front and upper side of the developing roller 31. The layer thickness regulation blade 33 contacts a front end portion of the developing roller 31 (e.g., a surface of the developing roller 31).

The toner chamber 34 is positioned at front side of the supply roller 32 and the layer thickness regulation blade 33. The toner chamber 34 is configured to accommodate toner. The toner chamber 34 includes an agitator 35.

The agitator 35 is rotatably supported by the developing cartridge 30 in the toner chamber 34.

The scanner unit 4 is positioned upper side of the process cartridge 3. The scanner unit 4 is configured to emit laser beam toward the photosensitive drum 13 based on image data.

The fixing unit 5 is positioned rear side of the process cartridge 3. The fixing unit 5 includes a heat roller 36 and a pressure roller 37 pressed against a lower end portion of the heat roller 36 (e.g., a surface of the heat roller 36).

As the printer 1 starts an image forming operation, the scorotron charger 14 positively and uniformly charges a surface of the photosensitive drum 13. The scanner unit 4 exposes the surface of the photosensitive drum 13 with light based on the image data. Thus, an electrostatic latent image based on the image data is formed on the surface of the photosensitive drum 13.

The agitator 35 agitates the toner in the toner chamber 34 and supplies the toner to the supply roller 32. The supply roller 32 supplies the toner supplied by the agitator 35 to the developing roller 31. At this time, the toner is positively charged between the developing roller 31 and the supply roller 32 by friction, and is carried on the developing roller 31. The layer thickness regulation blade 33 regulates the thickness of the toner layer carried on the developing roller 31 to a constant thickness.

Then, the toner carried on the developing roller 31 is supplied to the electrostatic latent image on the surface of the photosensitive drum 13. Thus, the toner image is carried on the surface of the photosensitive drum 13.

The sheets P are supplied one by one at a predetermined timing from the sheet supply tray 27 between the photosensitive drum 13 and the transfer roller 15, with the rotation of various rollers. The toner image on the surface of the photosensitive drum 13 is transferred to the sheet P when the sheet P passes between the photosensitive drum 13 and the transfer roller 15.

Thereafter, heat and pressure are applied to the sheet P when the sheet P passes between the heat roller 36 and the pressure roller 37. Thus, the toner image on the sheet P is thermally fixed on the sheet P. Thereafter, the sheet P is discharged onto the sheet discharge tray 9.

The first cleaning roller 16 and the second cleaning roller 17 are charged to a positive polarity greater than the potential of the surface of the photosensitive drum 13. More specifically, the second cleaning roller 17 is charged to have a greater positive polarity than the first cleaning roller 16.

Paper powders or fibers attached to the photosensitive drum 13 are collected on the first cleaning roller 16 when the paper powders or fibers contact the first cleaning roller 16. In other words, the first cleaning roller 16 cleans a surface of the photosensitive drum 13. Paper powders or fibers collected on the first cleaning roller 16 are collected on the second cleaning roller 17 when the paper powders or fibers contact the second cleaning roller 17.

Thereafter, the paper powders or fibers collected on the second cleaning roller 17 are scraped by the sponge scraper 23 and stored in the paper dust reservoir 26.

2. Details of Drum Cartridge

Figure 2:
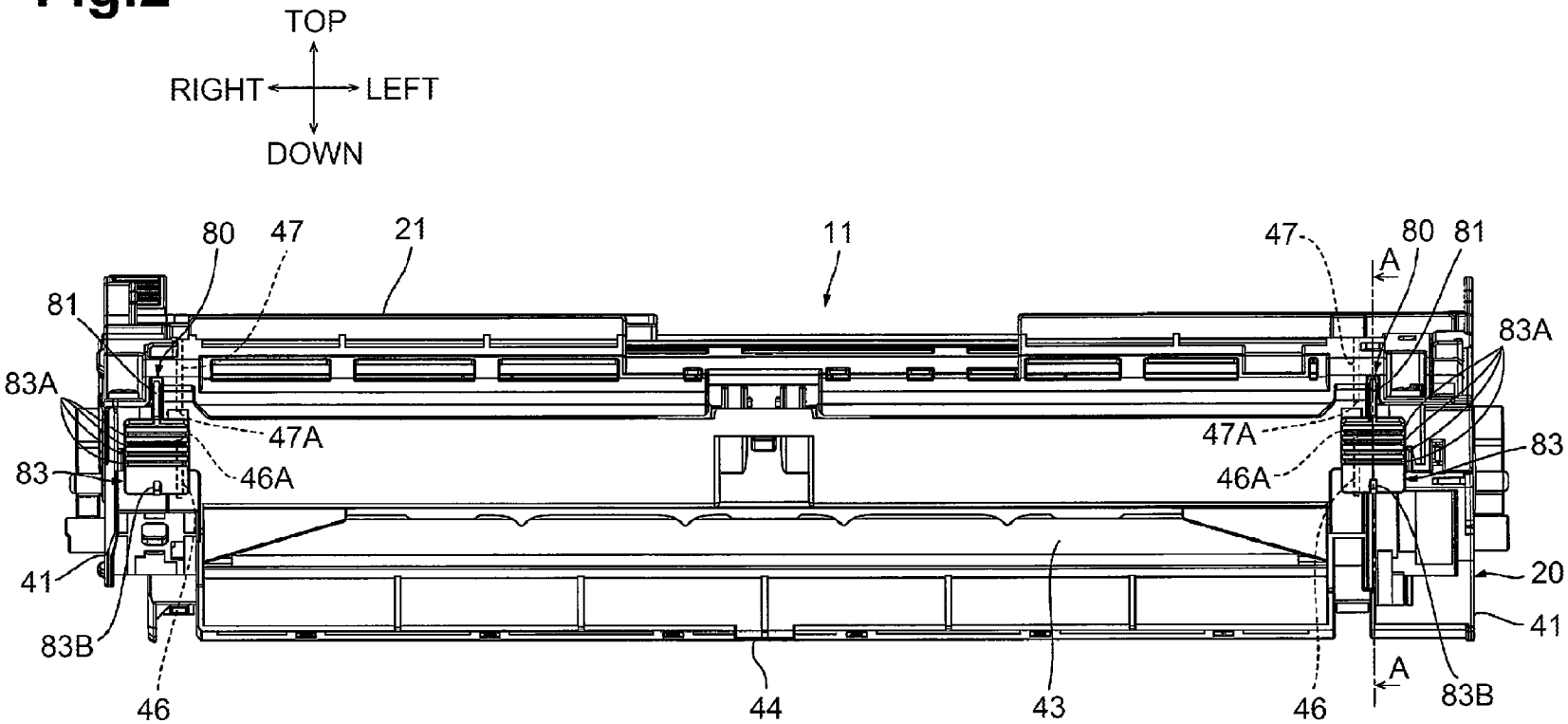
FIG. 2 is a rear view of a drum cartridge depicted in FIG. 1.
Figure 3:
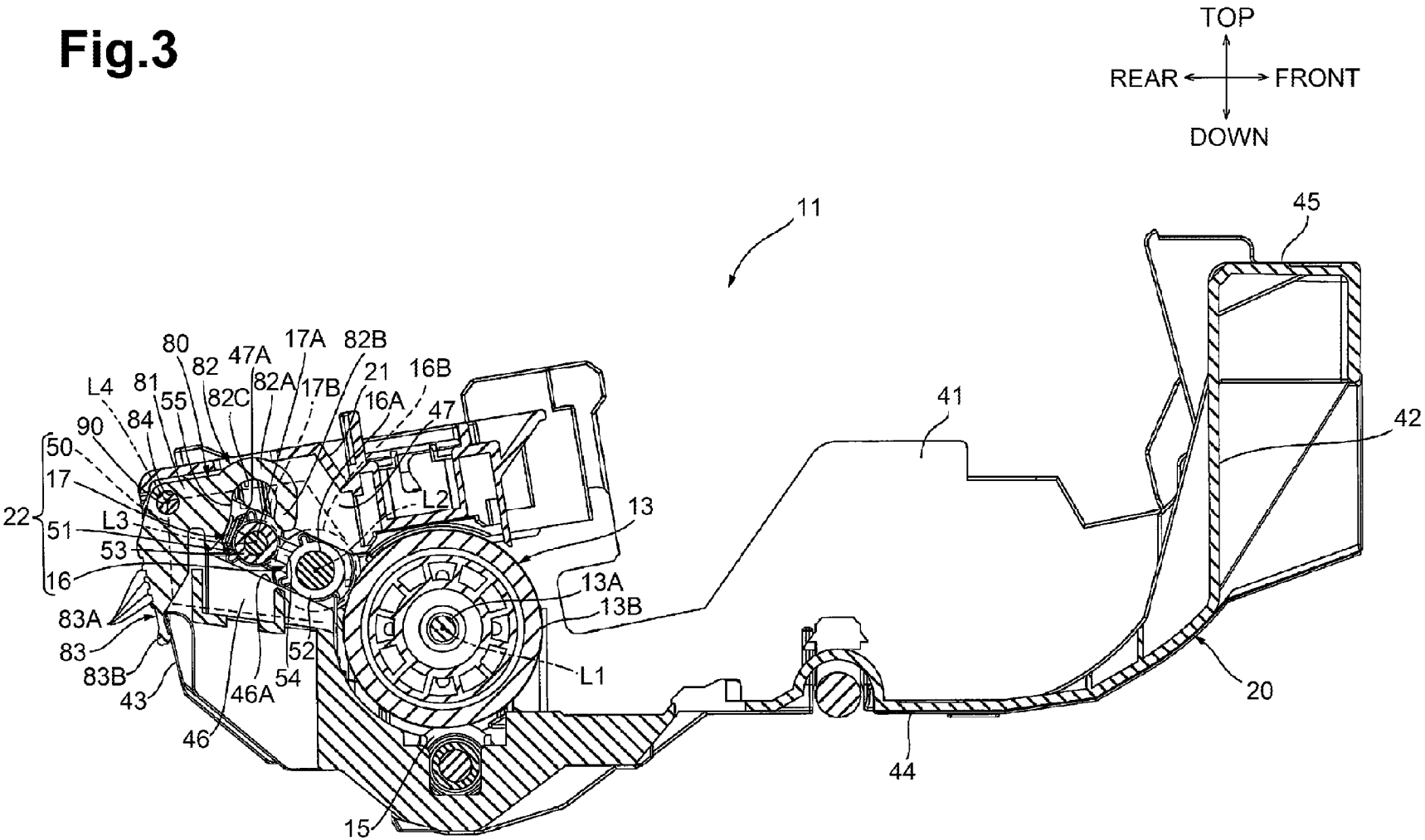
FIG. 3 is a sectional view of the drum cartridge depicted in FIG. 2 taken along a line A-A.

As depicted in FIGS. 2 and 3, the drum cartridge 11 includes a base frame 20, a cover frame 21, and a cleaning unit 22. The base frame 20 and the cover frame 21 are one of examples of a frame of the drum cartridge 11.

(1) Base Frame

The base frame 20 has a generally rectangular shape in plane view. The base frame 20 has a bottomed frame shape. The base frame 20 is integrally provided with a pair of side walls 41, a front wall 42, a rear wall 43, and a bottom wall 44.

Each side wall 41 is disposed at a respective end portion of the base frame 20 in the left-right direction. Each side wall 41 has a generally rectangular flat plate shape in side view. Each side wall 41 extends in the front-rear direction.

The front wall 42 extends between front end portions of the side walls 41. The front wall 42 has a generally rectangular flat plate shape in front view. The front wall 42 extends in the left-right direction. The front wall 42 includes a drum cartridge holding portion 45 (e.g., grip).

The rear wall 43 extends between rear end portions of the side walls 41. The rear wall 43 has a generally rectangular flat plate shape in front view. The rear wall 43 extends in the left-right direction.

The bottom wall 44 extends between lower end portions of the side walls 41, a lower end portion of the front wall 42 and a lower end portion of the rear wall 43. The bottom wall 44 has a generally rectangular flat plate shape in plane view. The bottom wall 44 extends in the left-right direction. A rear end portion of the bottom wall 44 extends upward.

A pair of lower guide ribs 46 is positioned at a rear portion of the bottom wall 44. More specifically, each lower guide rib 46 protrudes upward from a respective end portion of a rear portion of the bottom wall 44 in the left-right direction. Each lower guide rib 46 has a generally rectangular plate shape in side view. The upper edge of each lower guide rib 46 serves as a lower guide portion 46A. The lower guide portion 46A of each lower guide rib 46 is inclined along a direction that connects the upper-rear side and the lower-front side when projected in the left-right direction.

(2) Cover Frame

The cover frame 21 has a generally rectangular plate shape in plane view. The cover frame 21 covers the upper end of a rear portion of the base frame 20. The cover frame 21 includes a pair of upper guide ribs 47.

Each upper guide rib 47 is positioned at a respective end portion of a rear portion of the cover frame 21 in the left-right direction. Each upper guide rib 47 has a generally rectangular plate shape in side view. Each upper guide rib 47 extends downward from the cover frame 21. The lower edge of each upper guide rib 47 serves as an upper guide portion 47A. The upper guide portion 47A of each upper guide rib 47 is inclined along a direction that connects the upper-rear side and the lower-front side when projected in the left-right direction. The upper guide portion 47A of each upper guide rib 47 is positioned above the corresponding lower guide portion 46A of each lower guide rib 46 with a space. The upper guide portion 47A of each upper guide rib 47 and the corresponding lower guide portion 46A of each lower guide rib 46 extend parallel to each other when projected in the left-right direction.

The photosensitive drum 13 is positioned between the cover frame 21 and a rear portion of the base frame 20. More specifically, the photosensitive drum 13 is accommodated by the cover frame 21 and a rear portion of the base frame 20.

As depicted in FIG. 3, the photosensitive drum 13 includes a drum shaft 3A extending in the left-right direction, and a drum body 3B having a generally tubular shape and covering an outer peripheral surface of the drum shaft 3A. Each end portion of the drum shaft 3A of the photosensitive drum 13 in the left-right direction is rotatably supported by the relevant side wall 41, and the photosensitive drum 13 is configured to rotate about a first axis extending in the left-right direction.

(3) Cleaning Unit

Figure 5:
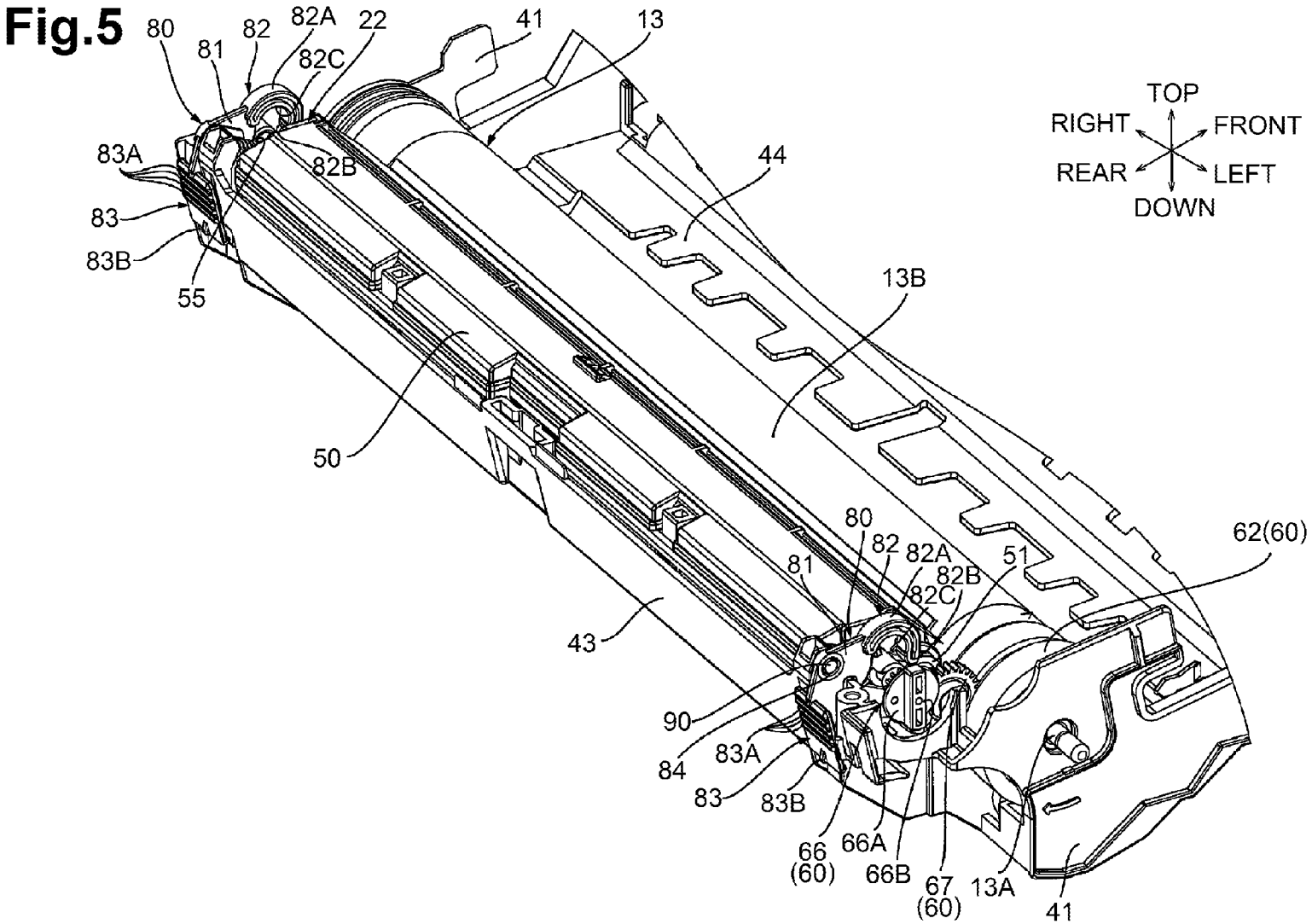
FIG. 5 is a perspective view of the drum cartridge depicted in FIG. 2 when viewed from a rear left side, illustrating a state in which a lever is positioned in a first position.

The cleaning unit 22 is positioned between the cover frame 21 and a rear portion of the base frame 20. More specifically, the cleaning unit 22 is positioned behind the photosensitive drum 13. As depicted in FIGS. 3 and 5, the cleaning unit 22 includes the cleaning frame 50, the first cleaning roller 16, the second cleaning roller 17, and a pair of bearings 51.

The cleaning frame 50 has a generally U-shape in side view. The cleaning frame 50 has a generally box shape extending in the left-right direction and a front end portion of the cleaning frame 50 is open. The cleaning frame 50 accommodates the first cleaning roller and the second cleaning roller rotatably. The sponge scraper 23, the partition wall 24, the film 25, and the paper dust reservoir 26 is positioned in the cleaning frame 50 (not depicted).

The first cleaning roller 16 is positioned at a front end portion of the cleaning frame 50. The first cleaning roller 16 includes a first cleaning shaft 16A and a first cleaning body 16B.

The first cleaning shaft 6A has a generally cylindrical shape extending in the left-right direction. A diameter of the first cleaning shaft 6A is smaller than a distance between the lower guide portion 46A and the upper guide portion 47A. As depicted in FIG. 5, each end portion of the first cleaning shaft 16A in the left-right direction is exposed from a respective end portion of the cleaning frame 50 in the left-right direction.

The first cleaning body 16B covers a portion of the first cleaning shaft 16A except each end portion of the first cleaning shaft 16A in the left-right direction. A lower front portion of the first cleaning body 16B (e.g., a surface of the first cleaning body 16B) contacts an upper rear portion of the photosensitive drum 13 (e.g., a surface of the photosensitive drum 13).

The second cleaning roller 17 is positioned at an upper rear portion of the first cleaning roller 16 in the cleaning frame 50. The second cleaning roller 17 includes a second cleaning shaft 17A and a second cleaning body 17B.

The second cleaning shaft 17A has a generally cylindrical shape extending in the left-right direction. A diameter of the second cleaning shaft 17A is smaller than a distance between the lower guide portion 46A and the upper guide portion 47A. As depicted in FIG. 5, each end portion of the second cleaning shaft 17A in the left-right direction is exposed from a respective end portion of the cleaning frame 50 in the left-right direction.

The second cleaning body 17B covers a portion of the second cleaning shaft 17A except each end portion of the second cleaning shaft 17A in the left-right direction. A lower front portion of the second cleaning body 17B (e.g., a surface of the second cleaning body 17B) contacts an upper rear portion of the first cleaning body 16B (e.g., a surface of the first cleaning body 16B).

Figure 4:
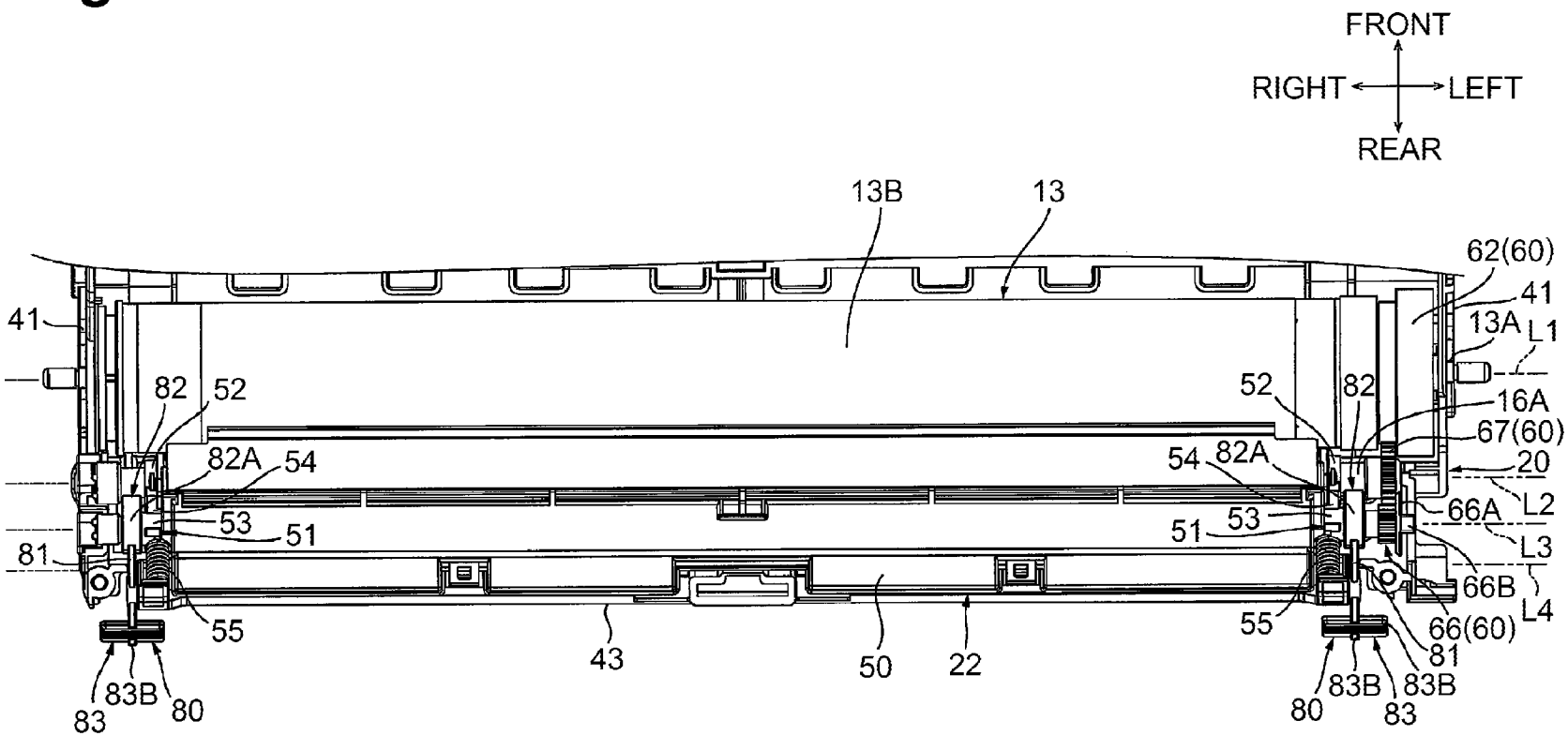
FIG. 4 is a sectional view of a rear portion of the drum cartridge depicted in FIG. 3, illustrating a cover frame being removed from the drum cartridge.

As depicted in FIGS. 3 and 4, each bearing 51 is positioned at a respective end portion of the cleaning frame 50 in the left-right direction. More specifically, each bearing 51 is mounted on a respective end portion of the first cleaning shaft 16A and a respective end portion of the second cleaning shaft 17A. Each bearing 51 rotatably receives a respective end portion of the first cleaning shaft 16A in the left-right direction and a respective end portion of the second cleaning shaft 17A in the left-right direction.

Figure 6A:
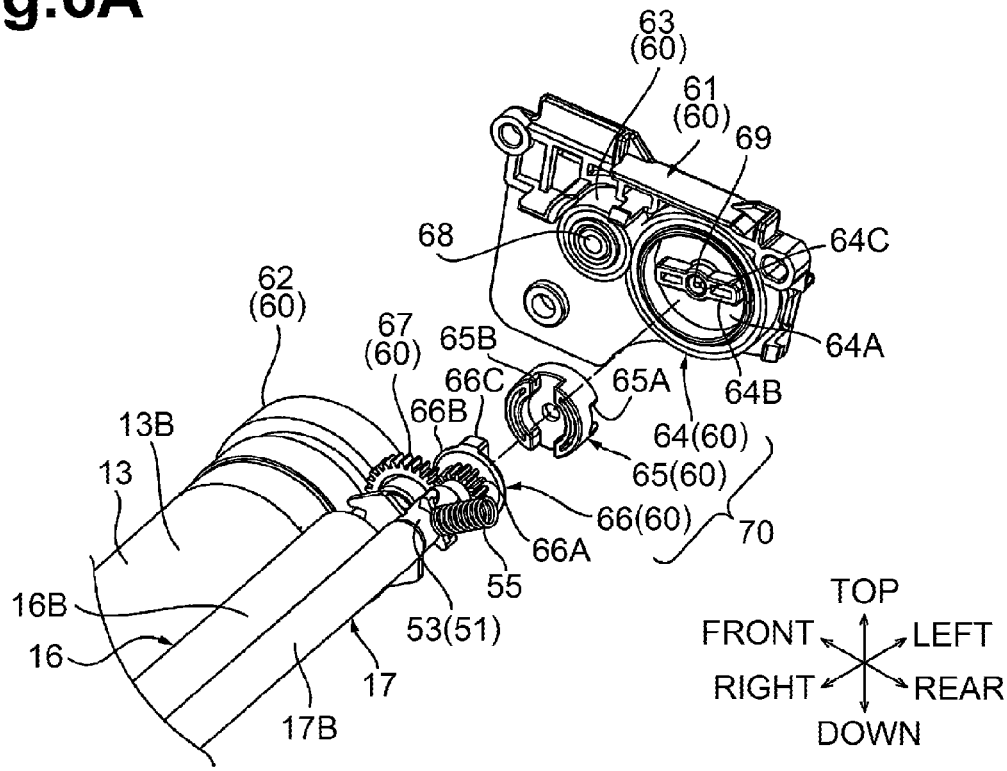
FIG. 6A is a perspective view of a driving unit of the drum cartridge depicted in FIG. 2 when viewed from a rear right side.
Figure 6B:
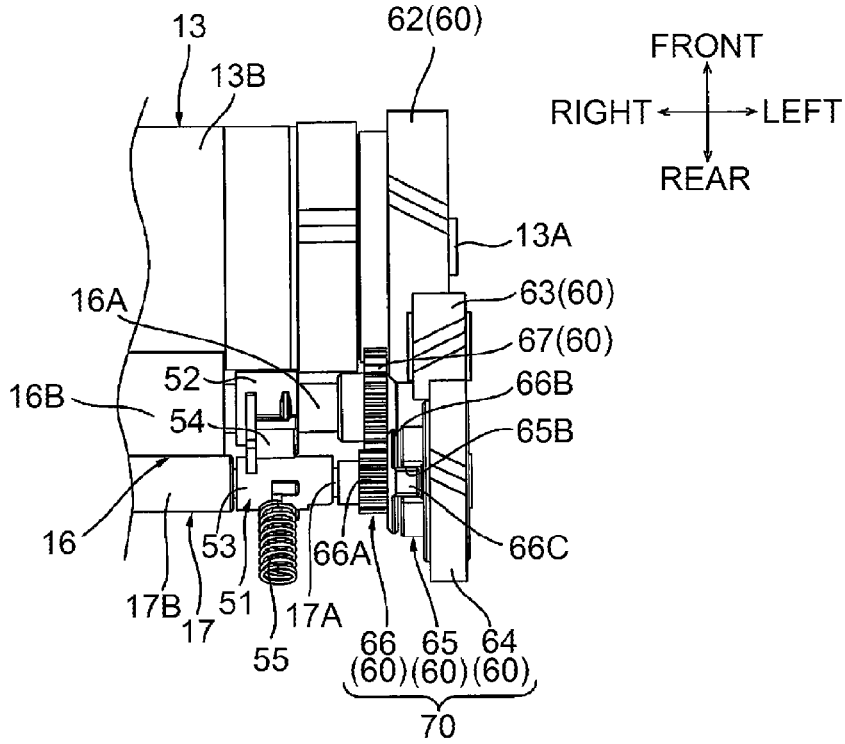
FIG. 6B is a plan view of the driving unit 60 of the drum cartridge as depicted in FIG. 2.

As depicted in FIG. 6B, each bearing 51 includes a first holding member 52, a second holding member 53, and a bearing connecting member 54.

A depicted in FIGS. 3 and 4, the first holding member 52 of each bearing 51 is a generally cylindrical shape. The first holding member 52 of each bearing 51 rotatably holds a respective end portion of the first cleaning shaft 16A in the left-right direction. As depicted in FIG. 3, the first holding member 52 of each bearing 51 is positioned between the lower guide portion 46A of the respective lower guide rib 46 and the upper guide portion 47A of the respective upper guide rib 47.

A depicted in FIGS. 3 and 4, the second holding member 53 of each bearing 51 is a generally cylindrical shape. The second holding member 53 of each bearing 51 rotatably holds a respective end portion of the second cleaning shaft 17A in the left-right direction. As depicted in FIG. 3, the second holding member 53 of each bearing 51 is positioned between the lower guide portion 46A of the respective lower guide rib 46 and the upper guide portion 47A of the respective upper guide rib 47.

As depicted in FIGS. 3 and 4, the bearing connecting member 54 of each bearing 51 connects the first holding member 52 and the second holding member 54.

Therefore, the first cleaning roller 16 is configured to rotate about an axis line L2 extending in the left-right direction. Furthermore, the second cleaning roller 17 is configured to rotate about an axis line L3 extending in the left-right direction. Each bearing 51 keep a certain distance between the axis line L2 and the axis line L3.

As depicted in FIG. 3, the cleaning unit 22 is configured to move along the direction that connects the upper-rear side and the lower-front side, as the first holding member 52 and the second holding member 53 of each bearing 51 are guided by the lower guide portion 46A of the respective lower guide ribs 46 and the upper guide portion 47A of the respective upper guide ribs 47. As depicted in FIG. 4, a pressing member, e.g., a spring 55, is positioned a rear portion of each end portion of the cleaning unit 22 in the left-right direction.

One end portion of each spring 55 is supported by an upper end portion of the rear wall 43. The opposite end portion of each spring 75 is engaged with the respective second holding member 53 of each bearing 51. Thus, each spring 55 is positioned in a compressed state between an upper end portion of the rear wall 43 and the respective bearing 51. Each bearing 51 is constantly urged by the respective spring 55 toward a lower-front side. In other words, the cleaning unit 22 is constantly urged by the springs 55 toward a lower-front side. Thus, the first cleaning roller 16 is constantly pressed against the photosensitive drum 13 by the springs 55.

(4) Drive Unit

As depicted in FIGS. 6A and 6B, a drive unit 60 is disposed at the left side of the photosensitive drum 13, the first cleaning roller 16, and the second cleaning roller 17.

The drive unit 32 includes a gear holder 61, a drum gear 62, a first idle gear 63, a second idle gear 64, a slider 65, a second cleaning gear 66, and a first cleaning gear 67.

The gear holder 61 has a generally rectangular plate shape in side view. The gear holder 61 is configured to be attached to a rear end of the side walls 41. The gear holder 61 is not described in the FIG. 2-5, FIG. 6B, and FIG. 9A. As depicted in FIG. 6A, the gear holder 61 includes a first boss 68 and a second boss 69. The first boss protrudes toward the right direction from a center of a right surface of the gear holder 61. The second boss 69 protrudes toward the right direction from a rear portion of a right surface of the gear holder 61. The second boss 69 is positioned at rear side of the first boss 68 with a space between the first boss 68 and the second boss 69.

As depicted in FIGS. 6A and 6B, the drum gear 62 has a generally cylindrical shape extending in the left-right direction. The drum gear 62 is connected to the left end of the drum shaft 13A so as not to be rotatable relative to the drum shaft 13A.

The first idle gear 63 has a generally cylindrical shape extending in the left-right direction. The first idle gear 63 is connected to the first boss 68 of the gear holder 61 so as to be rotatable relative to the first boss 68. A lower front portion of the first idle gear 63 meshes with an upper rear portion of the drum gear 96.

The second idle gear 64 has a generally cylindrical shape extending in the left-right direction. The second idle gear 64 includes a closed portion 64A and a projection 64B.

The closed portion 64A is positioned at left end portion of the second idle gear 64. The closed portion 64A has a generally disc shape in side view and closes a left end of the second idle gear 64.

The projection 64B protrudes toward the right direction from a right surface of the closed portion 64A. The projection 64B has a generally rectangular cylinder shape. The projection 64B extends along a diametric direction of the closed portion 64A.

A through hole 64C penetrates through substantially centers of the closed portion 64A and the projection 64B in the left-right direction. The through hole 64C has a generally circular shape in side view.

The second idle gear 64 is connected to the second boss 69 of the gear holder 61 so as to be rotatable relative to the second boss 69, by engaging the second boss 68 with the through hole 64C. An upper end portion of the second idle gear 64 meshes with a lower end portion of the first idle gear 63.

The slider 65 has a generally cylindrical shape extending in the left-right direction. The slider 65 includes a left slide part 65A and a right slide part 65B.

The left slide part 65A is groove which is recessed rightward relative to a left surface of the slider 65 and extends along a diametric direction of the slider 65. A width of the left slide part 65A is slightly wider than a width of the projection 64B of the second idle gear 64.

The right slide part 65B is groove which is recessed leftward relative to a right surface of the slider 65 and extends along a diametric direction of the slider 65. The right slide part 65B extends in a direction perpendicular to a direction that the left slide part 65A extends as viewed in the left-right direction.

The left slide part 65A engages with the projection 64B of the second idle gear 64. Therefore, the slider 65 can slide along the projection 64B of the second idle gear 64.

The second cleaning gear 66 includes a gear portion 66A, a circular plate 66B, and a projection 66C.

The gear portion 66A has a generally cylindrical shape extending in the left-right direction. The gear portion 66A is connected to the left end of the second cleaning shaft 17A so as not to be rotatable relative to the second cleaning shaft 17A.

The circular plate 66B is positioned at a left end of the gear part 66A.

The circular plate 66B has a generally circular shaped plate, and a circumference of the circular plate 66B is larger than a circumference of the gear part 66A. The circular plate 66B closes the left end portion of the gear part 66A.

The projection 66C protrudes toward the left direction from a left surface of the circular plate 66B. The projection 66C has a generally rectangular cylinder shape. The projection 66C extends along a diametric direction of the circular plate 66B. A width of the projection 66C is slightly smaller than a width of the right slide part 65B. The projection 66C engages with the right slide part 65B. Therefore, the slider 65 can slide along the projection 66C of the second cleaning gear 66.

The first cleaning gear 67 has a generally cylindrical shape extending in the left-right direction. The first cleaning gear 67 is connected to the left end of the first cleaning shaft 16A so as not to be rotatable relative to the first cleaning shaft 16A. An upper end portion of the first cleaning gear 67 meshes with the gear part 66A of the second cleaning gear 66.

An Oldham coupling 70 in the drive unit 60 is configured by the second idle gear 64, the slider 65 and the cleaning gear 66.

(5) Lever

Levers 80 are disposed at both end portions of the cleaning unit 22 in the left-right direction. One of the levers 80 is disposed at one end portion of the cleaning unit 22 in the left-right direction, and other of the levers 80 is disposed at other end portion of the cleaning unit 22 in the left-right direction.

More specifically, as depicted in FIG. 5, the levers 80 are attached to both end portions of the rear wall 43 in the left-right direction corresponding to both end portions of the cleaning unit 22 in the left-right direction. In the description below, the levers 80 will be explained with reference to a state in which the release levers 80 are separated from the bearings 51.

Figure 7:
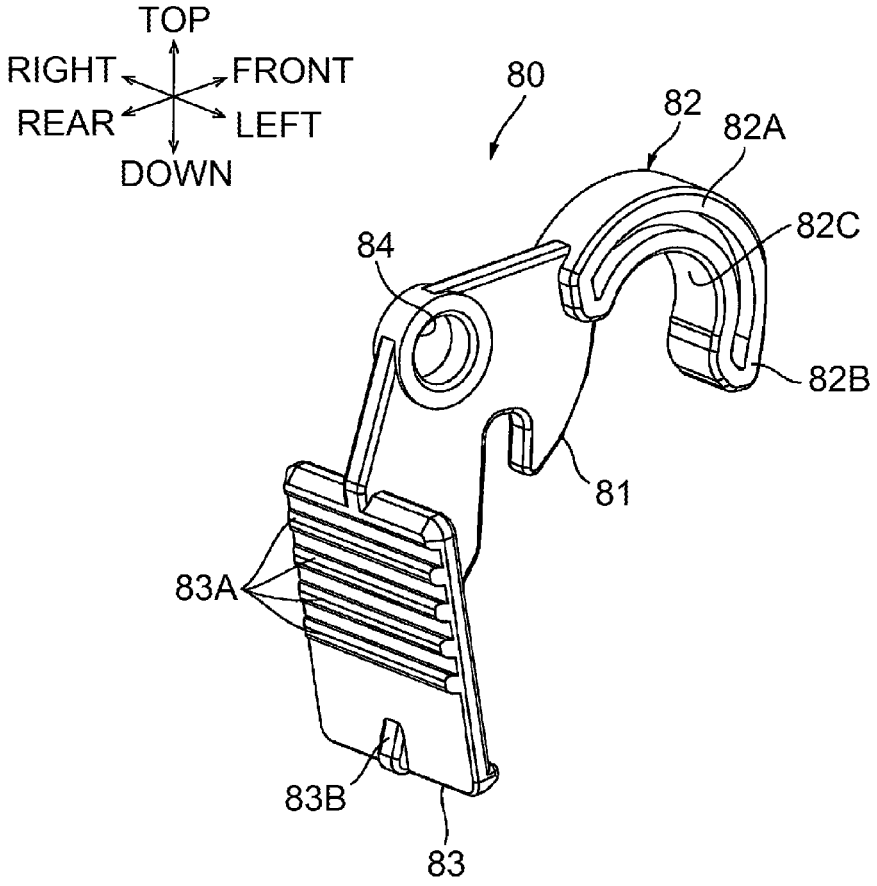
FIG. 7 is a perspective view of a lever of the drum cartridge when viewed from a rear left side.

As depicted in FIG. 7, each of the levers 80 includes a proximal portion 81, a hook 82, and a handle 83.

The proximal portion 81 has a generally obtuse triangular plate shape in side view. The proximal portion 81 has an obtuse-angled portion at its upper rear end in side view. The proximal portion 81 has an engagement hole 84.

The engagement hole 84 is defined in the obtuse-angled portion of the proximal portion 81 and has a circular shape in side view. The engagement hole 84 penetrates through the proximal portion 81.

The hook 82 is contiguous to a front end portion of the proximal portion 81 in side view. The hook 82 has a generally arc shape in side view. The hook 82 extends downward and curved in side view from a front end of the proximal portion 81. The hook 62 includes a curved portion 82A and a front edge portion 82B.

The curved portion 82A a portion of the hook 82 from one end portion of the proximal portion 81 to approximately a front edge portion of the hook 82. The curved portion 82A has a generally arc shape in side view. An inner surface of the curved portion 82A a holding portion 82C. The holding portion 82C has a shape following a shape of the second holding member 53.

The front edge portion 82B is a front edge portion of the hook 82. The front edge portion 82B extends from a front edge of the curved portion 82A along a tangential direction of the curved portion 82A in side view.

The handle 83 is contiguous to a rear end of the proximal portion 81 in side view. That is, the handle 83 is disposed at opposite side of the hook 82 with respect to the engagement hole 84. The handle 83 has a generally rectangular plate shape in rear view. The handle 83 extends downwardly from other end portion of the proximal portion 81 in side view, and the handle 83 extends in a direction perpendicular to a direction that the proximal portion 81 extends. The handle 83 includes a plurality of first protrusions 83A and a second protrusion 83B.

The plurality of first protrusions 83A prevent the handle 83 from sipping, when an user operates the handle 83. The plurality of first protrusions 83A protrudes from a rear surface of the handle 83 and extends in the left-right direction.

The second protrusion 83B is disposed at down end portion of the rear surface of the handle 83. The second protrusion 83B protrudes from the rear surface of the handle 83 toward the rear direction.

As depicted in FIG. 3 and FIG. 5, engagement protrusions 90 are disposed at both end portions of rear wall 43 in the left-right direction. One engagement protrusion 90 is disposed at one end portion of rear wall 43 in left-right direction, and other engagement protrusion 90 is disposed at other end portion of rear wall 43 in left-right direction.

The engagement protrusions 90 protrude from upper end portion of the rear wall 43 in the left-right direction and the engagement protrusions 90 are protrudes from both end portions of the rear wall 43 in the left-right direction. Each of the engagement protrusions 90 has a substantially a circular cylindrical shape extending in the left-right direction. A diameter of each of the engagement protrusions 90 is smaller than a diameter of the engagement hole 84.

The engagement hole 84 of each of the levers 80 engages with the respective engagement protrusions 90. This configuration enables each of the release levers 80 to pivot about axis line L4 extending in the left-right direction. Each of the levers 80 pivots clockwise about the axis line L4 in left side view, and each of levers 80 can engage with the respective bearing 51 in a first position.

On the other hand, each of the levers 80 pivots anticlockwise about the axis line L4 in left side view, and an engagement of each of levers 80 and the respective bearing 51 can be released in a second position.

Figure 10:
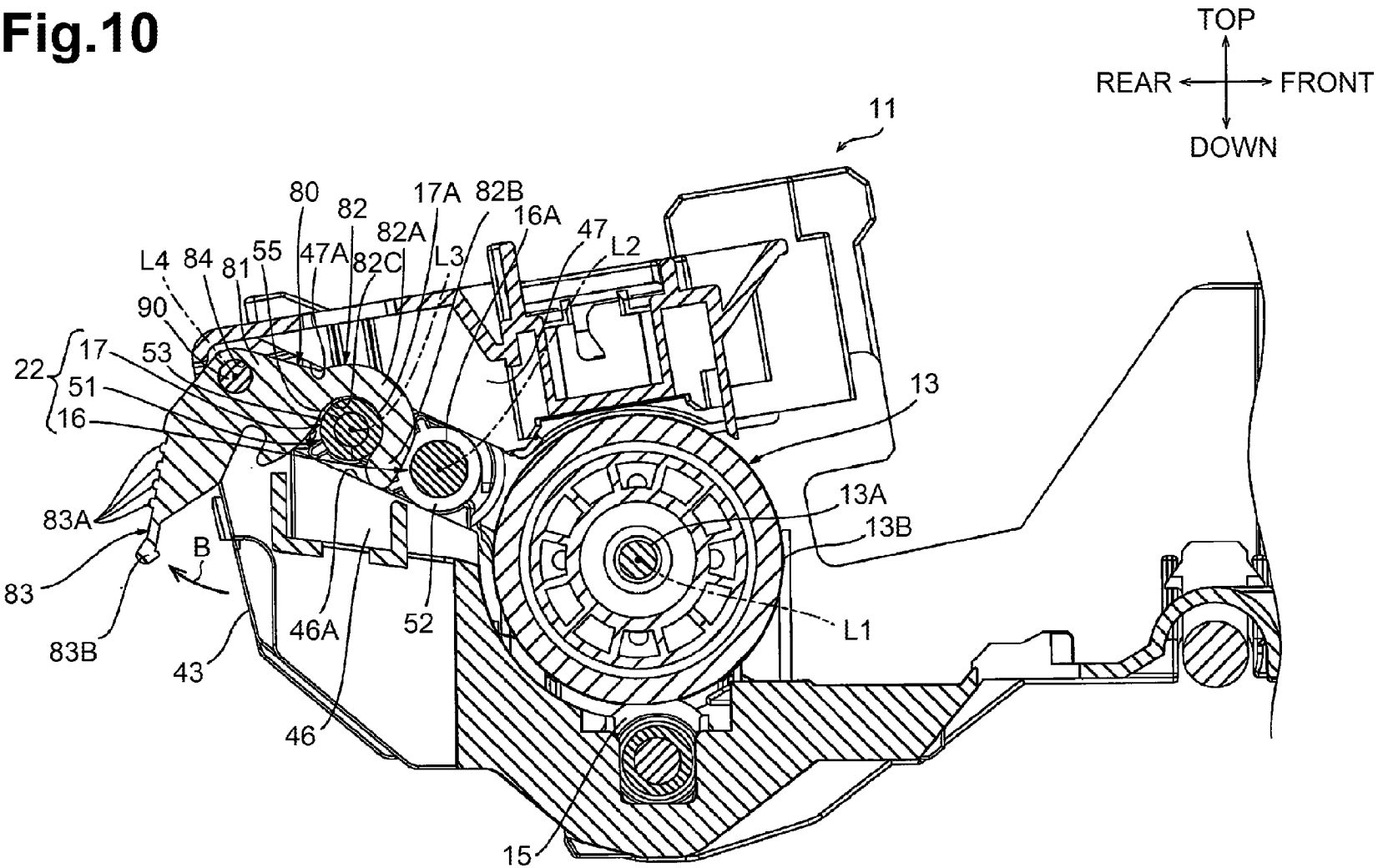
FIG. 10 is a sectional view of a rear portion of the drum cartridge depicted in FIG. 2, illustrating a state in which a lever is positioned in a second position.

As depicted in FIG. 10, the holding member 82C of each of the levers 80 extends along the second holding member 53 of the respective bearing 51 in a state in which each of the levers 80 engages with the respective bearing 51.

3. Driving of Driving Unit

As depicted in FIG. 1, when the printer 1 starts to image forming movement, driving force is transmitted to the photosensitive drum 13 from a motor (not depicted) of the printer 1, and the photosensitive drum 13 rotates about the axis line L1 counterclockwise in left side view.

As depicted in FIGS. 6A and 6B, the drum gear 62 rotates clockwise in left side view with a rotation of the photosensitive drum 13.

The first idle gear 63 rotates anticlockwise in left side view with a rotation of the drum gear 62, and the second idle gear 64 rotates clockwise in left side view with a rotation of the first idle gear 63.

The projection 64B engages with the left slide part 65A, and the slider 65 rotates clockwise in left side view with a rotation of the second idle gear 64.

The right slide part 65B engages with the projection 66C, and the second cleaning gear 66 rotates clockwise in left side view with a rotation of the slider 65. And then, the first cleaning gear rotates anticlockwise in left side view.

Therefore, the second cleaning roller 17 can rotates clockwise in left side view, and the first cleaning roller 16 can rotate anticlockwise in left side view.

In some case, a position of the cleaning unit 22 (e.g., a position of the first cleaning roller 16 and a position of the second cleaning roller 17) is shifted in a direction perpendicular to the left-right direction. In other words, as depicted in FIG. 3, the axis line L2 and the axis line L3 are sifted in a direction perpendicular to the left-right direction.

In this case, the projection 66C slides along the right slide part 65B with engaging the projection 66C and the right slide part 65B and/or the slider 65 slides along the projection 64B with engaging the slider 65 and the projection 64B.

For this reason, even though the cleaning unit is shifted in a direction perpendicular to the left-right direction, in other words, the first cleaning roller 16 is shifted relative to the photosensitive drum 13, the driving force can transmit sequentially the slider 65, the second cleaning gear 66 and the first cleaning gear 67 from the second idle gear 64.

4. Movement of Lever

Figure 8A:
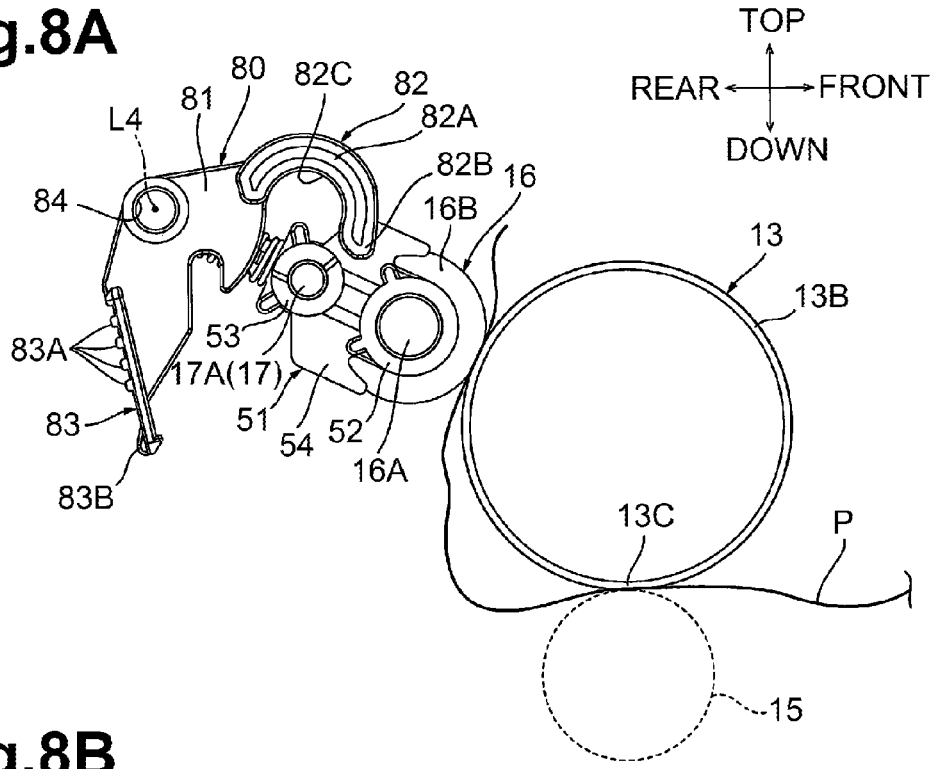
FIG. 8A is a side view of a photosensitive drum and a first cleaning roller of the drum cartridge as depicted in FIG. 2, illustrating a contact state in which a surface of the photosensitive drum contacts a surface of the first cleaning roller.

As depicted in FIGS. 5 and 8A, when the printer 1 forms an image, each of the levers 80 does not engage with the respective bearing 51.

In this state, each handle 83 corresponding to each of the levers 80 is adjacent the rear wall 83 (e.g., each of the levers 80 extends along the real wall 83). Each hook 82 corresponding to each of the levers 80 is far away from the respective bearing 51.

Each of the bearings 51 is pressed toward the photosensitive drum 13 by pressing force of the respective spring 55. That means that cleaning unit 22 is pressed toward the photosensitive drum 13 by pressing force of each of the springs 55. And then, the first cleaning roller 16 contacts a surface of the photosensitive drum 13 and press a surface of the photosensitive drum 13 by constant pressing force. At this time, the first cleaning roller 16 is positioned at a contacting position.

In this state, the photosensitive drum 13, the first cleaning roller 16, and the second cleaning roller 17 are arranged in a direction from the upper-rear side to the lower-front side. That means that the axis line L1 of the photosensitive drum 13, the axis line L2 of the first cleaning roller 16, and the axis line L3 of the second cleaning roller 17 are arranged in a direction from the upper-rear side to the lower-front side.

In the above-described image forming operation, when the sheet is, for example, curved, a leading end portion of the sheet P may enter between the photosensitive drum 13 and the first cleaning roller 16, after passing the transfer position 13C of the photosensitive drum 13, as depicted in FIG. 8A. In this case, an operator stops the image forming operation in the printer 1 and pulls or removes the sheet P from a portion between the photosensitive drum 13 and the first cleaning roller 16.

More specifically, an operator first removes the process cartridge 3 from the main casing 2. Then, as represented by an arrow B in in FIGS. 9 and 10, the operator lifts up each handle 83.

When each handle 83 is lifted up, each of the levers 80 pivots clockwise about the axis line L4 in left side view. And then, each hook 82 corresponding to each of the levers 80 engages with the respective bearings 51. More specifically, each holding portion 82C corresponding to each of the levers 80 engages with the respective second holding member 53 corresponding to each of the bearings 51.

Figure 8B:
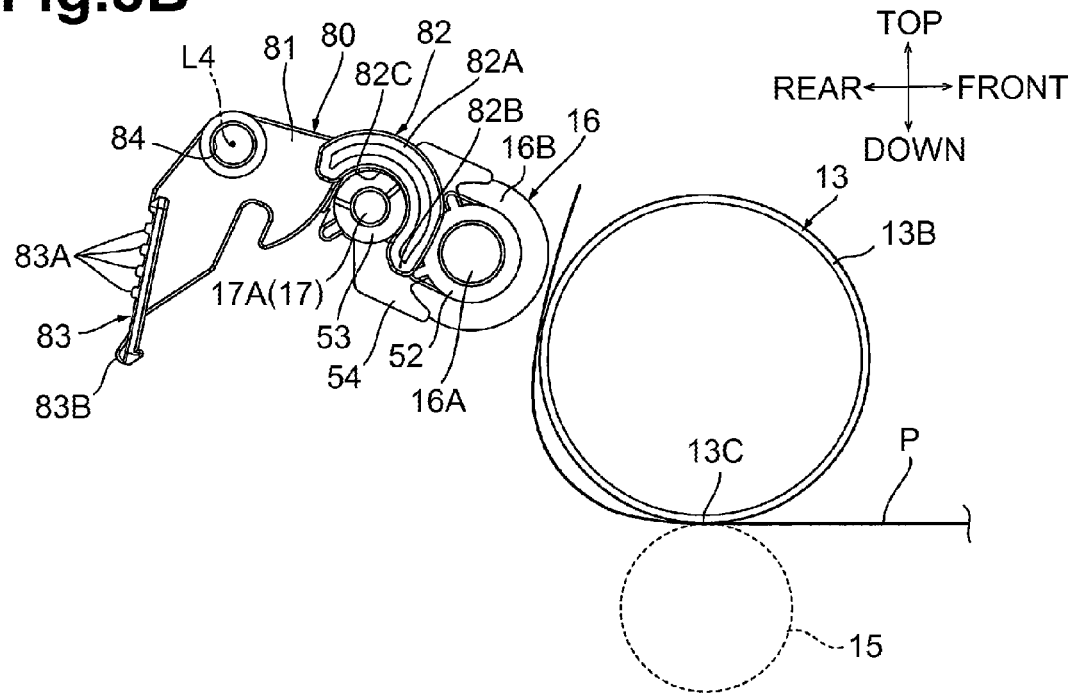
FIG. 8B is a side view of the photosensitive drum and the first cleaning roller of the drum cartridge as depicted in FIG. 2, illustrating a separate state in which a surface of the photosensitive drum is separated from a surface of the first cleaning roller.
Figure 9:
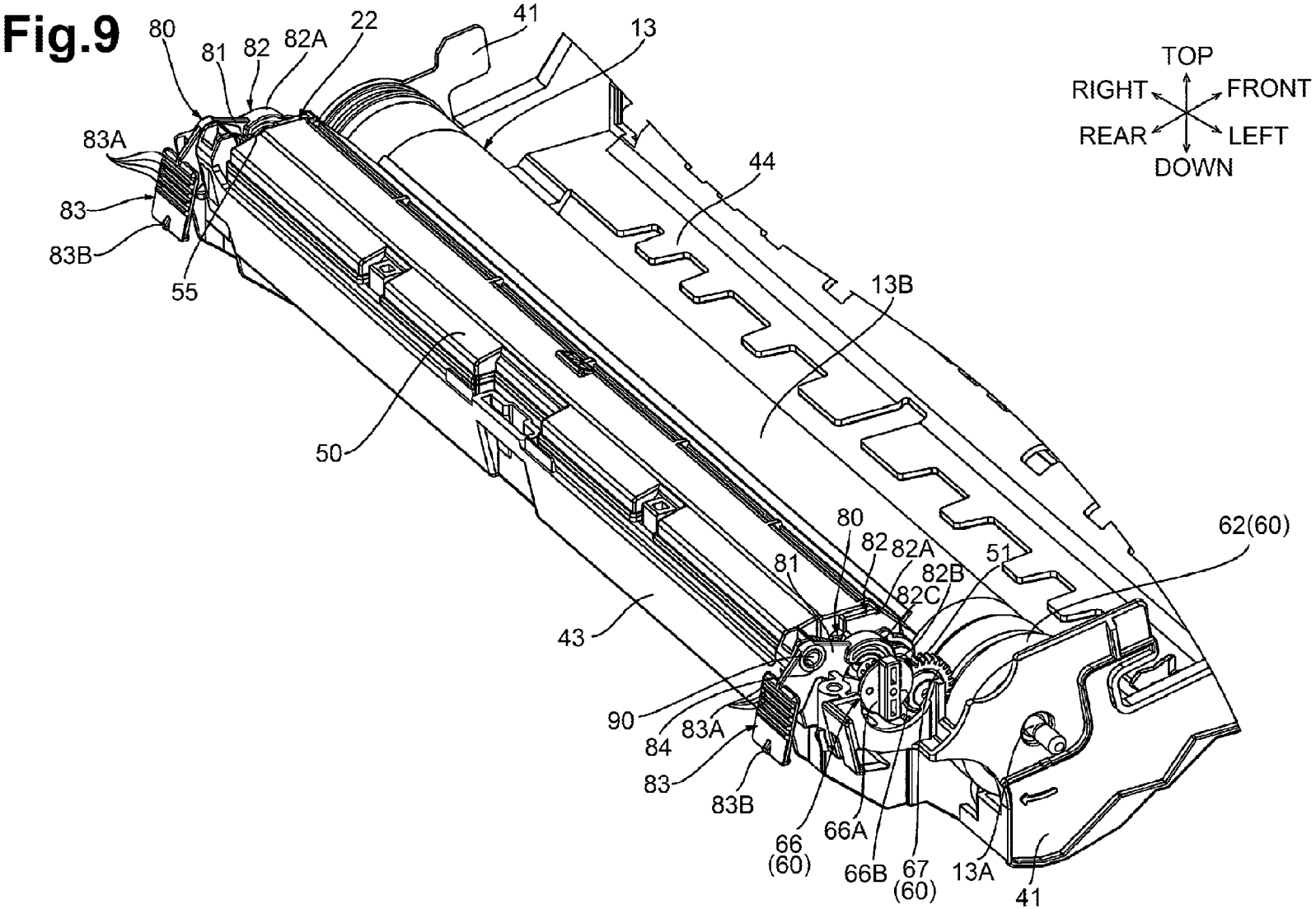
FIG. 9 is a perspective view of the drum cartridge depicted in FIG. 2 when viewed from a rear left side, illustrating a state in which a lever is positioned in a second position.

As depicted in FIG. 8B, each hook 82 of each of the levers 80 lift up the respective bearing 51 upward and rearward against the pressing force of the springs 55.

At this time, the bearings 51 of the cleaning unit 22 are guided by the lower guide portions 46A of the corresponding lower guide ribs 46 and the upper guide portions 47A of the corresponding upper guide ribs 47, so that the cleaning unit 22 moves rearward and upwardly. As a result, the cleaning unit 22 is placed at a position where the cleaning unit 22 is separated from a surface of the photosensitive drum 13. That means that a surface of the first cleaning roller 16 is separated from a surface of the photosensitive drum 13.

At this time, each engagement hole 84 corresponding to each of the levers 80, each holding portion 82C corresponding to each of the levers 80, and each second holding member 53 corresponding to each of the bearing 51 are arranged in a direction that connects the upper-rear side and the lower-front side in side view. In other words, each engagement hole 84 corresponding to each of the levers 80, each holding portion 82C corresponding to each of the levers 80, and each second holding member 53 corresponding to each of the bearing 51 are arranged in a pressing direction in which the springs 55 press. Each second holding member 53 presses the respective holding portion 82C by the pressing force of the springs 55.

Therefore, a state in which each holding portion 82C engages with the respective second holding member 53 keeps.

In this state, the operator pulls the sheet P forwardly from the process cartridge 3, and removes the sheet P from a portion between the photosensitive drum 13 and the first cleaning roller 16.

Thereafter, the operator presses each handle 83 corresponding to each of the levers 80 forwardly.

When the operator presses each handle 83 corresponding to each of the levers 80 forwardly, as depicted in FIG. 3, each of the levers 80 pivots anticlockwise about the axis line L4 in left side view. And then, an engagement each of the levers 80 and each of the bearings 51 is released. That means that each of the levers 80 does not engage with each of the bearings 51.

Alternatively, when the operator installs the process cartridge 3 in the main casing 2, each of the levers 80 may be lifted up and each holding portion 82C corresponding to each of the levers 80 may engage with each second holding member 53 corresponding to each of the bearings 51.

Figure 11A:
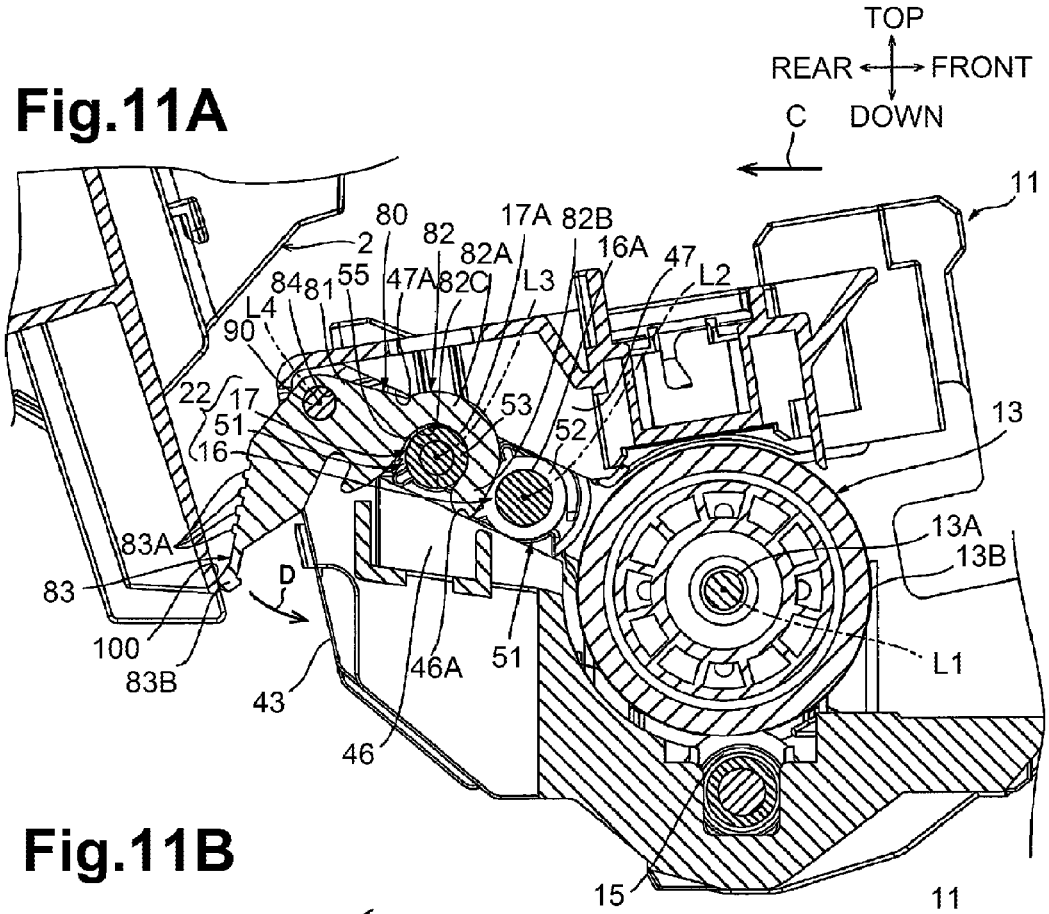
FIG. 11A is a sectional view of a rear portion of the drum cartridge depicted in FIG. 2, illustrating a state in which the lever in the second position contacts a main casing of the printer.
Figure 11B:
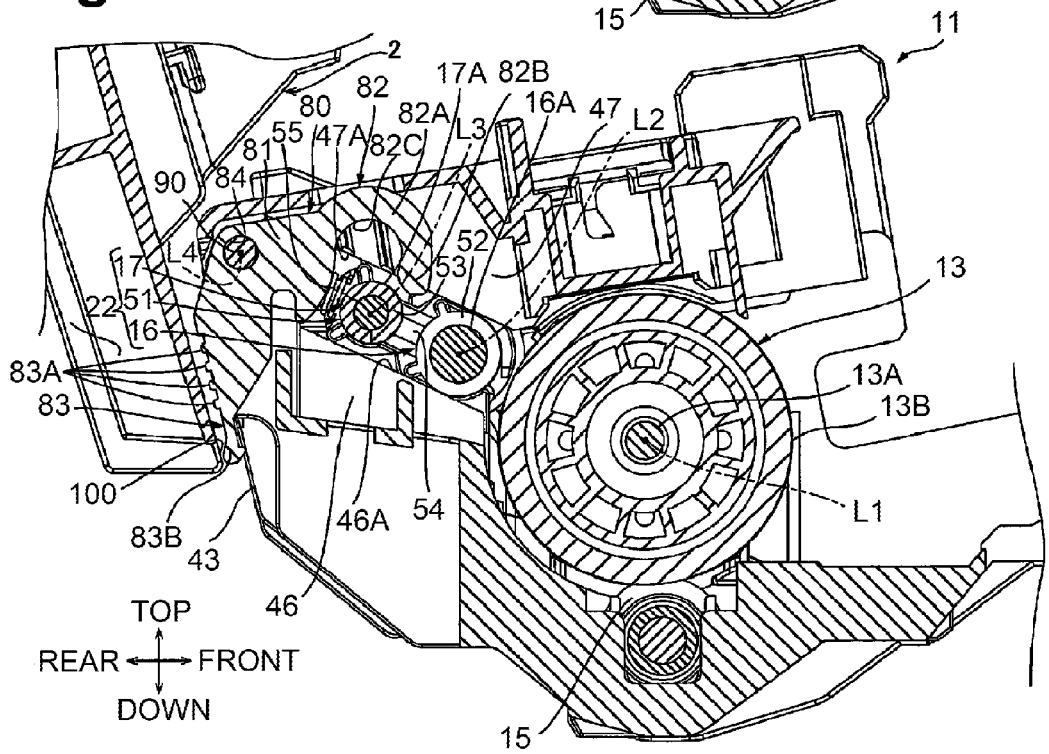
FIG. 11B is a sectional view of a rear portion of the drum cartridge depicted in FIG. 2, illustrating a state in which the lever in the first position after the lever contacts the main casing of the printer.

In this case, as depicted in FIG. 11A, each second protrusion 83B corresponding to each of the levers 80 can contact a contact portion 100 of the main casing 2, when the operator installs the process cartridge 3 in the main casing 2.

And then, as represented by an arrow C in FIG. 11A, the operators further moves the process cartridge 3 in the main casing 2, each second protrusion 83B corresponding to each of the levers 80 is pressed forwardly by contacting the contact portion 100.

Therefore, as represented by an arrow D in FIG. 11A, each of the levers 80 pivots anticlockwise about the axis line L4 in left side view. And then, an engagement each of the levers 80 and each of the bearings 51 is released. That means that each of the levers 80 does not engage with each of the bearings 51.

5. Effects (1) In the drum cartridge 11, as depicted in FIG. 10, the first cleaning roller 16 is configured to move between a contact position in which a surface of the first cleaning roller 16 contacts a surface of the photosensitive drum 13 and a separate position in which a surface of the first cleaning roller 16 is separated from a surface of the photosensitive drum 13. Each of levers 80 engages with the respective bearings 51, and each of levers 80 move the first cleaning roller 16 from the contact position to the separate position. Furthermore, an engagement each of the levers 80 and each of the bearings 51 is released, and then, the first cleaning roller 16 is moved from the separate position to the contact position.

Therefore, when the sheet P gets caught between the first cleaning roller 16 and the photosensitive drum 13, the first cleaning roller 16 is moved from the contact position to the separate position by operating each of the levers 80 and engaging each of the levers 80 with the respective bearings 51, and the operator can removes the sheet P from a portion between the photosensitive drum 13 and the first cleaning roller 16.

(2) In the drum cartridge 11, as depicted in FIG. 10, each of the levers 80 pivots about the axis line L4 and each of the levers 80 is configured to move the first cleaning roller 16 between the contact position and the separate position.

Therefore, each of the levers 80 can move the first cleaning roller 16 between the contact position and separate position smoothly.

(3) In the drum cartridge 11, as depicted in FIG. 10, when the operator operates the handle 83, each of the levers 80 pivots about the engagement hole 84. And then, each hook 82 engages with each of the bearings 51 or each hook 82 is released from an engagement with each of the bearings 51 with a pivoting of each of the levers 80.

Therefore, each of the levers 80 help the operator to engage each hook 82 and the each of the bearings 51 easily, and each of the levers 80 help the operator to release an engagement each hook 82 and the each of the bearings 5 easily.

(4) In the drum cartridge 11, as depicted in FIG. 10, each holding portion 82C can keep an engagement state in which each of the levers 80 and the respective bearings 51.

Therefore, each holding portion 82C can keep the first cleaning roller 16 in the separate position.

Therefore, when the sheet P gets caught between the first cleaning roller 16 and the photosensitive drum 13, it is much easier for the operator to remove the sheet P from a portion between the photosensitive drum 13 and the first cleaning roller 16 further easily.

(5) In the drum cartridge 11, as depicted in FIG. 10, each of the bearings engages with the each holding portion 82C corresponding to each of the levers 80, and the first cleaning roller 16 is held in the separate position.

When an engagement each of the bearings 51 and each holding portion 82C corresponding to each of the levers 80 is released, the first cleaning roller 15 is surely moved to the contact position by the pressing force of the springs 55.

(6) In the drum cartridge 11, as depicted in FIG. 10, the base frame 2 includes the lower guide portions 46A, and the cover frame 21 includes the upper guide portions 47A.

The lower guide portions 46A and the upper guide portions 47A extend along the pressing direction in which the springs 75 press the first cleaning roller 16. The lower guide portions 46A and the upper guide portions 47A constitute guide portions configured to guide the movement of the first cleaning roller 16 between the contact position and the separate position.

Therefore, the lower guide portions 46A and the upper guide portions 47A can smoothly move the first cleaning roller 16 between the contact position and the separate position.

(7) In the drum cartridge 11, as depicted in FIG. 8A, each of the levers 80 includes the hook 82 having a generally arc shape in side view. Each hook 82 corresponding to each of the levers 80 engages with the respective bearing 51.

Therefore, each of the levers 80 is configured to engage with the respective bearing 51 easily.

(8) In the drum cartridge 11, as depicted in FIG. 2, one of the levers 80 is disposed at a left end portion of the cleaning unit 22 in the left-right direction, and other of the levers 80 is disposed at a right end portion of the cleaning unit 22 in the left-right direction.

Therefore, each of the levers 80 can engage with the respective bearing 51.

Consequently, a surface of the first cleaning roller 16 can contact and/or separate a surface of the photosensitive drum 13 in a well-balanced state in the left-right direction.

(9) In the drum cartridge 11, as depicted in FIG. 6A, the drive unit 60 includes the drum gear 62, the first idle gear 63, the second idle gear 64, the slider 65, the second cleaning gear 66, and the first cleaning gear 67. The Oldham coupling 70 is configured by the second idle gear 64, the slider 65, and the second cleaning gear 66.

Therefore, even though a position of the cleaning unit 22 is shifted (e.g., the first cleaning roller 16 is shifted relative to the photosensitive drum 13), the driving force can transmit from the drum gear 62 to the second cleaning gear 66 via the first idle gear 63, the second idle gear 64, and the slider 65.

Therefore, the first cleaning roller can be rotated stably.

(10) In the drum cartridge 11, as depicted in FIG. 11A, each of the levers 80 includes the second protrusion 83B. The second protrusion 83B can contact a contact portion 100 of the main casing 2, and then each of the levers 80 pivots anticlockwise about the axis line L4 in left side view. When each of the levers 80 pivots anticlockwise about the axis line L4 in left side view, the first cleaning roller is moved from the separation position to the contact position.

Therefore, even though each of the levers 80 is lifted up and the first cleaning roller 16 is in the separate position when the operator installs the process cartridge 3 in the main casing 2, the second protrusion 83B can contact a contact portion 100 of the main casing 2, and the first cleaning roller is moved from the separation position to the contact position.

Consequently, a surface of the first cleaning roller 16 surely contacts a surface of the photosensitive drum 13, when the process cartridge 3 is installed in the main casing 2.

6. Second Illustrative Embodiment

Figure 12A:
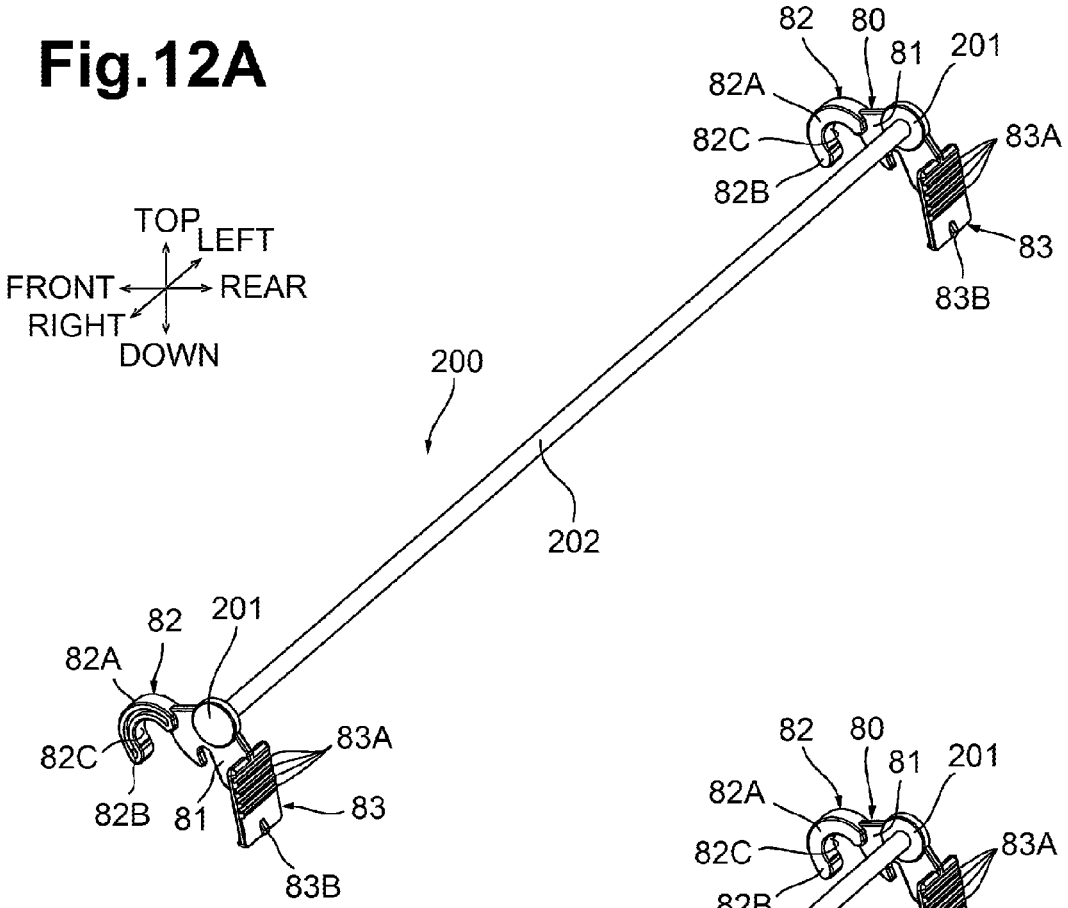
FIG. 12A is a side view of the lever of drum cartridge depicted in FIG. 2 in a second illustrative embodiment according to one or more aspects of the disclosure.

Referring to FIG. 12A, the drum cartridge 11 according to a second illustrative embodiment will be described. Like reference numerals may be used for like corresponding components and a detailed description thereof with respect to the second illustrative embodiment may be omitted herein.

In the first illustrative embodiment, as depicted in FIG. 2, each of the levers 80 is different component and each of the levers 80 is attached to the rear wall 43. That means that each of the levers 80 can pivot respectively. On the other hand, in the second illustrative embodiment, each of the can pivot integrally. More specifically, the proximal portion 81 includes an attachment portion 201 instead of the engagement hole 84 at the obtuse-angled portion. The attachment portion 201 has a circular plate shape in side view. Each of the levers 80 is connected to a connecting portion 202.

The connecting portion 202 has a cylindrical shape extending in the left-right direction. A left end portion of the connecting portion 202 is connected to one lever 80 on the left side (hereinafter, is referred to as "left lever"). More specifically, a left end portion of the connecting portion 202 is connected to a right end portion of the attachment portion 201 in the left lever and rotates with pivoting of the left lever. A right end portion of the connecting portion 202 is connected to other lever 80 on the right side (hereinafter, is referred to as "right lever"). More specifically, a right end portion of the connecting portion 202 is connected to a left end portion of the attachment portion 201 in the right lever and rotates with pivoting of the right lever.

Therefore, the left lever and the right lever is connected to the connecting portion 202 and the left lever and the right lever can pivot with a rotation of the connecting portion 202.

In the second illustrative embodiment, the drum cartridge 11 further includes the connecting portion 202 connecting the left lever and the right lever.

Consequently, the left lever and the right lever can pivot with a rotation of the connecting portion 202. When the operator operates at least one of the right lever and the left lever, both right lever and left lever can engage with the respective bearing 51 simultaneously. When the operator operates at least one of the right lever and the left lever, engaging both right lever and left lever with the respective bearing 51 can be released simultaneously.

6. Third Illustrative Embodiment

Figure 12B:
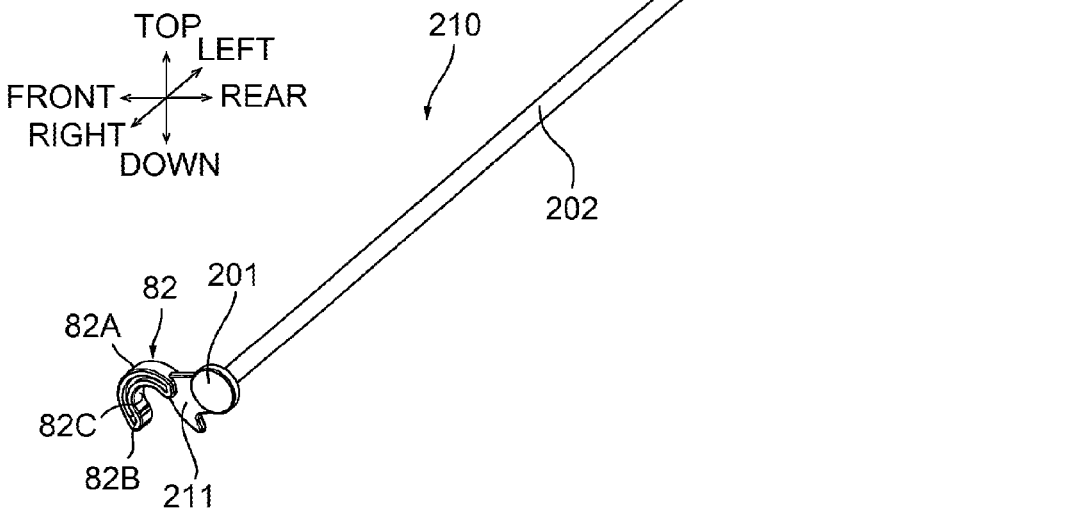
FIG. 12B is a side view of the lever of drum cartridge depicted in FIG. 2 in a third illustrative embodiment according to one or more aspects of the disclosure.

Referring to FIG. 12B, the drum cartridge 11 according to a third illustrative embodiment will be described. Like reference numerals may be used for like corresponding components and a detailed description thereof with respect to the third illustrative embodiment may be omitted herein. In the second illustrative embodiment, each of the levers 80 includes the handle 83 respectively, and each of the levers 80 is connected to the connecting portion 202.

In the third illustrative embodiment, the left lever includes the handle 83, and the right lever does not include the handle 83. In other words, only the left lever includes the handle 83.

In the third illustrative embodiment, when the operator operates the handle 83 of the left lever, the connecting portion 202 can rotate, and the right lever can pivot with a rotation of the connecting portion 202.

While the disclosure has been described in detail with reference to the specific embodiments thereof, this is merely an example, and various changes, arrangements and modifications may be applied therein without departing from the spirit and scope of the disclosure.

What is claimed is:

1. A drum cartridge comprising:

a photosensitive drum rotatable about an axis extending in a first direction;

a first cleaning roller positioned to a side of the photosensitive drum and including a first shaft extending in the first direction;

a bearing through which the first shaft is inserted;

a pressing member configured to press the bearing toward the photosensitive drum;

a lever positioned at an outer surface of the drum cartridge, the outer surface of the drum cartridge positioned toward the side of the photosensitive drum, the lever extendable in a second direction different from the first direction, the lever being pivotable with respect to the outer surface of the drum cartridge about a second axis extending in the first direction, the lever pivotable between an extended position and a retracted position;

an engagement portion movable with pivoting of the lever between an engaged position when the lever is in the extended position and a disengaged position when the lever is in the retracted position, wherein, in the engaged position the engagement portion engages the bearing to position the first cleaning roller spaced apart from the photosensitive drum, and in the disengaged position the engagement portion disengages from the bearing and the first cleaning roller contacts the photosensitive drum.

2. The drum cartridge according to claim 1, wherein, in a case where the lever is in the extended position, in response to attachment of the drum cartridge to an image forming apparatus, the lever pivots about the second axis from the extended position to the retracted position.

3. The drum cartridge according to claim 1, further comprising a frame shaped to receive a developing cartridge.

4. The drum cartridge according to claim 1, wherein in the extended position, an end of the lever is a first distance from the outer surface and in the retracted position the end of the lever is a second distance from the outer surface, wherein the first distance is greater than the second distance.

5. The drum cartridge according to claim 1, wherein in the extended position, the lever extends from the outer surface at a first angle, and in the retracted position the lever extends from the outer surface at a second angle, wherein the first angle is greater than the second angle.

6. The drum cartridge according to claim 5, wherein in the retracted position the lever is positioned along the outer surface.

7. The drum cartridge according to claim 1, wherein the second direction is perpendicular to the first direction.

8. The drum cartridge according to claim 7, wherein the second axis is positioned toward the second direction from the first roller.

9. The drum cartridge according to claim 8, wherein the second axis is located at the outer surface, and wherein the outer surface is positioned toward the second direction from the first roller.

10. The drum cartridge according to claim 1, wherein the lever includes the engagement portion.

11. The drum cartridge according to claim 1, wherein the lever includes a handle that is contiguous with the engagement portion.

12. The drum cartridge according to claim 1, wherein, in the engaged position, the engagement portion holds the bearing to counteract the pressing force of the pressing member and separate a surface of the first cleaning roller from a surface of the photosensitive drum.

13. The drum cartridge according to claim 1, wherein the engagement portion is a hook, and wherein the hook engages the bearing to counteract the pressing force of the pressing member and hook the bearing, in a case that the lever is in the engaged position.

14. The drum cartridge according to claim 13, wherein, in a case where the lever is in the retracted position, the hook is unhooked from the bearing.

15. The drum cartridge according to claim 14, wherein the second lever is the same as the lever.

16. The drum cartridge according to claim 15, further comprising:

a third shaft extending in the first direction, the third shaft connecting to the lever and the second lever, wherein the lever and the second lever pivot about the third shaft.

17. The drum cartridge according to claim 16, wherein the third shaft and each of the lever a disposed at the first end and the second lever disposed at the second end are integrally formed.

18. The drum cartridge according to claim 1, further comprising:

a drum frame supporting the photosensitive drum rotatably, the drum frame including:

a third shaft extending along the second axis in the first direction, wherein the lever is configured to pivot about the third shaft.

19. The drum cartridge according to claim 1, wherein the first cleaning roller has a first end and a second end opposing to the first end in the first direction, and wherein the bearing is disposed at the first end and a second bearing is disposed at the second end of the cleaning roller, and wherein the lever is disposed at the first end and a second lever is disposed at the second end of the cleaning roller.

20. The drum cartridge according to claim 1, further comprising:

a guide configured to guide a movement of the bearing between the engaged position and the disengaged position.

21. The drum cartridge according to claim 1, further comprising:

a second cleaning roller including a second shaft, wherein a surface of the second cleaning roller contacts a surface of the first cleaning roller; and wherein the first shaft and the second shaft are both inserted through the bearing.

22. A method comprising:

pivoting a lever from an extended position to a retracted position, the lever extending from an outer surface at a side of a drum cartridge, the drum cartridge further including:

a photosensitive drum;

a first cleaning roller positioned toward the side of the drum cartridge relative to the photosensitive drum and including a first shaft extending in the first direction;

a bearing through which the first shaft is inserted;

a pressing member configured to press the bearing toward the photosensitive drum; and an engagement portion movable between an engaged position when the lever is in the extended position and a disengaged position when the lever is in the retracted position, wherein in the engaged position, the engagement portion engages the bearing to position the first cleaning roller spaced apart from the photosensitive drum, and wherein pivoting the lever from the extended position to the retracted position disengages the engagement portion from the bearing, allowing the first cleaning roller to contact the photosensitive drum.

23. The method of claim 22, further comprising pivoting the lever from the retracted position to the extended position to engage the bearing with the engagement portion and retract the first cleaning roller to a position spaced apart from the photosensitive drum.

24. The method of claim 22, further comprising inserting the drum cartridge into an image forming apparatus.

25. The method of claim 24, wherein pivoting the lever from the extended position to the retracted position occurs in response to contact between a surface of an image forming apparatus and the lever upon insertion of the drum cartridge into the image forming apparatus.

* * * * *